United States Patent [19]

Ichiryu et al.

[11] 4,036,041

[45] July 19, 1977

[54] GAGE CONTROL SYSTEM FOR ROLLING MILL

[75] Inventors: Ken Ichiryu, Mito; Toyotsugu Masuda, Hitachi; Haruo Kinoshita, Hitachi; Toshiyuki Kajiwara, Hitachi; Shigemichi Matsuka, Hitachi, all of Japan

[73] Assignee: Hitachi, Ltd., Japan

[21] Appl. No.: 657,271

[22] Filed: Feb. 11, 1976

[30] Foreign Application Priority Data

Feb. 12, 1975 Japan ..... 50-16872

[51] Int. Cl.[2] ..... B21B 37/00

[52] U.S. Cl. ..... 72/8; 72/11; 72/21

[58] Field of Search ..... 72/6, 8, 11, 19, 20, 72/21

[56] References Cited

U.S. PATENT DOCUMENTS 3,478,551 11/1969 Alsop ..... 72/8
3,580,022 5/1971 Waltz ..... 72/8
3,889,504 6/1975 Ichiryu et al. ..... 72/8
3,928,994 12/1975 Ichiryu et al. ..... 72/8

*Primary Examiner*—Milton S. Mehr
*Attorney, Agent, or Firm*—Craig & Antonelli

[57] ABSTRACT

A gage control system for a rolling mill for compensating for variation in the thickness of rolled material due to variations in the rolling load or pressure. In the system, the roll eccentricity frequency produced by the eccentricity of the rolls is detected and utilized for softening the effective rigidity or stiffness of the mill, that is, weakening the apparent mill modulus by control means according to the frequency of roll eccentricity. To this end, a positive feed back path including an eccentricity control unit is provided in parallel with a feed back path of the rolling pressure signal of a gage control circuitry of the so-called BISRA system. The eccentricity control unit serves to detect the roll eccentricity on the basis of a correlation principle and compensate for or cancel the effects of the feed back of the rolling pressure upon the occurrence of the roll eccentricity.

15 Claims, 5 Drawing Figures

GAGE CONTROL SYSTEM FOR ROLLING MILL

BACKGROUND OF THE INVENTION

1. Field of the Invention

The present invention relates to a thickness or gage control system for a rolling mill and in particular to a gage or thickness control system for eliminating the influence of roll eccentricity.

2. Description of the Prior Art

In these years, there has been an increasing demand for accuracy in the thickness of rolled strips and remarkable progress has been made in gagemeter type automatic thickness control systems on the basis of the so-called BISRA-AGC (automatic gage control developed by BRITISH IRON AND STEEL RESEARCH ASSOCIATION).

This gagemeter type automatic thickness control systen controls values such as a thickness command *hd*, no-load roll gap S, roling pressure P, and mill modulus Km so as to satisfy the following equation:

$$hd - (S + P/Km) = 0$$

These values are indispensible for controlling the thickness of strip in a rolling mill.

However, the hitherto known gagemeter type automatic thickness control system has suffered from disadvantages in that the presence of eccentricity in the respective rolls leads to failure in maintaining the roll gap constant, which makes the purpose of the thickness control itself utterly meaningless. In other words, the hitherto known gagemeter type control system is so designed as to decrease the roll gaps when the rolling pressure is increased on the assumption that the an increase in the rolling pressure has been caused by the increase in the thickness of a strip on the input side. However, when the roll gap is decreased due to roll eccentricity, the rolling pressure will be correspondingly increased, so that the control system will function so as to decrease the roll gap notwithstanding the need to increase the gap. Accordingly, it is an important problem imposed on the gagemeter type automatic gage control system to remove or exclude the influence of roll eccentricity.

Meanwhile, many attempt have so far been made to overcome the above problem. However, most of these attempts have failed to meet an intended success, because of over complicated construction or the failure to attain the desired accuracy, with the result of the necessity to resort to the skill or experience of operator to solve the above problem. For example, as one of the simplest attempt among the above referred to attempts, it has been proposed to modify the automatic gage control system such that the rolling pressure control is incorporated with a feed back loop including a resonance type filter for passing only the components of roll eccentricity frequency *fe* thereby to control the rolling pressure so as to cancel the roll eccentricity component in variation of the rolling pressure. However, this attempt has encountered disadvantages in that the so-called resonance type filter designed to have a resonance frequency at the roll eccentricity frequency *fe* have usually a resonance bandwith (sensitive zone width) of frequencies broader than the intended bandwith, whereby the signals having frequencies close to that of the signal to be passed therethrough, furthermore, exact tuning is very difficult too.

It has also been proposed as another attempt that the feed back quantity is subjected to Fourier analysis to extract the roll eccentricity component, which is then utilized as a command quantity for the thickness control. In this case, however, an adjustment of gain and correction of phase delay in the servo system has to be made with high accuracy, since the command is given as the eccentricity correction signal. This in turn requires a very complicated adjustment with the aid of an expensive computer. Besides, it involves a risk in that the roll eccentricity will be quite undesirably amplified, if the adjustment of gain and phase is erroneously effected.

SUMMARY OF THE INVENTION

Accordingly, an object of the present invention is to provide a gage control system for a rolling mill which is immune from the disadvantage of the hitherto known systems and can correct the roll eccentricity with a sufficiently high accuracy through a simplified and reliable system.

The gage control system according to the invention is based on a principle that the variation of rolling pressure due to the roll eccentricity is cancelled by decreasing the mill modulus or by softening the mill stiffness, when the roll eccentricity acts to increase the rolling pressure, thereby to prevent the roll eccentricity from affecting the thickness of the strip as rolled. As described above, the increased mill modulus is on the one hand very desirable in a usual thickness control, but exerts a very adverse influence on variation of thickness due to the roll eccentricity on the other hand. In view of this fact, it is contemplated according to the inventive thickness control that the mill stiffness is decreased only when the roll eccentricity acts to increase the rolling pressure, thereby to eliminate the adverse influence thereof to the whole thickness control operation.

DESCRIPTION OF THE PREFERRED EMBODIMENTS

Figure 1:
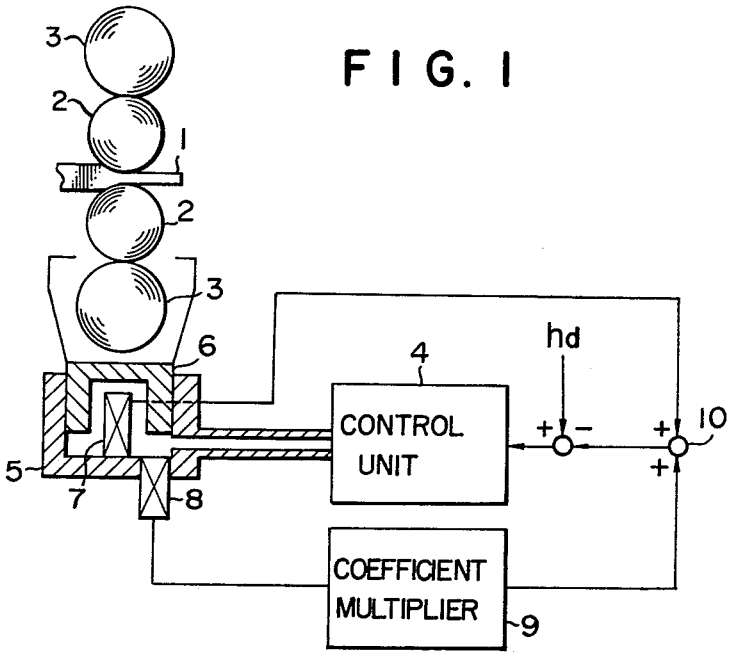
FIG. 1 shows schematically a general arrangement of a gagemeter type automatic thickness control system to which the present invention is applied.

Now, an automatic thickness control system of a gagemeter will be described by taking the BISRA AGC as an example. Referring to FIG. 1, a rolling mill shown therein comprises work rolls 2 serving to directly roll a strip 1 and backup rolls 3 externally supporting the work rolls 2. The roll screw-down operation of the rolling mill is accomplished by means of hydraulic jacks provided at the left hand and right hand ends of the rolls. The roll gap can be adjusted by changing the position of the ram 6 of the jacks as adjusting the amount of oil within the hydraulic jacks. For the thickness control at the time of rolling, displacement S of the ram 6 is measured by means of a displacement meter 7 and the result of the measurement is then negatively fed back to be compared with a thickness command *hd.* On the other hand, rolling load or pressure P is measured by a pressure gage 8 or load cell (not shown) and the measured value is then divided by a mill modulus or constant Km a a coefficient multiplier 9. The value thus resulted is subsequently multiplied by a load feed back coefficient $\alpha$ and applied to a summing junction 10 to be negatively fed back for the comparison with the thickness command *hd.* In this manner, the thickness of the rolled strip can be maintained by controlling the aforementioned various values so that the relation: $hd - (S + \alpha \cdot P/Km) = 0$ can be satisfied. Thus, the thickness control system of this type acts dynamically as if the mill stiffness is increased by increasing the value of $\alpha$ from 0 to 1 and thus assures an accurate thickness control. When the slope of the plasticity curve of a material to be rolled is represented by Kr and the ratio between the mill constant Km and the slope Kr, i.e. Kr/Km is represented by $\xi$, it is known that the ratio between the thickness $h_1$ at the input side and the thickness $h_2$ at the output side, in the quasi-static state, can be given by $\Delta h_2/\Delta h_1 = (1 - \alpha)\xi/[1 + \xi(1 - \alpha)]$. If $\alpha = 1$, then $\Delta h_2/\Delta h_1 = 0$ and the mill stiffness becomes infinitely great.

On the other hand, in case the backup rolls 3 and/or work rolls 2 have roll eccentricity *e,* the transfer ratio $\Delta h_2/e$ of the roll eccentricity *e* to the thickness variation $\Delta h_2$ at the output side is given by $1/[1 + \xi(1 - \alpha)]$. Accordingly, when $\alpha = 1$, $\Delta h_2/e = 1$.

It is thus apparent that the influence of the roll eccentricity exerted to the thickness variation becomes greater, as the mill stiffness is increased.

Figure 2:
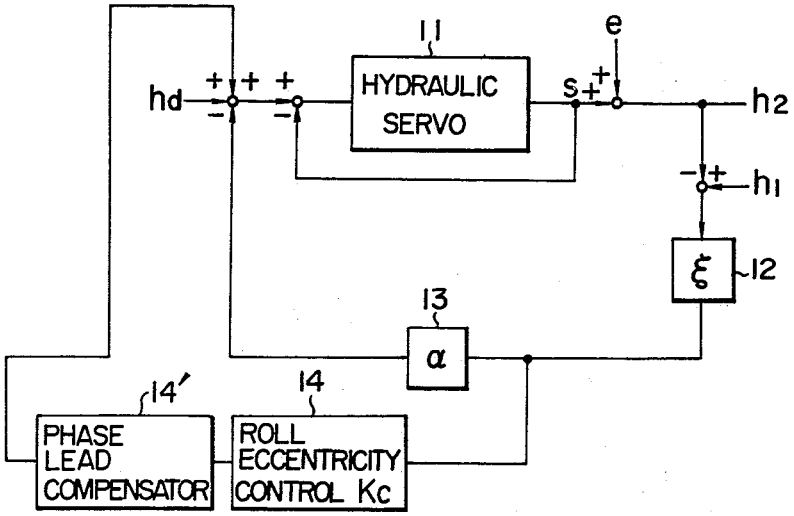
FIG. 2 is a block diagram showing an embodiment of the thickness control system according to the invention.

Referring to FIG. 2 which shows in a block diagram a thickness control system according to the invention, a hydraulic servo system 11 comprising a hydraulic jack and a servo valve is controlled in accordance with the thickness command *hd,* thereby to determine a ram displacement S (or roll gap). The rolling is effected in accordance with the ram displacement S to attain a desired thickness $h_2$ at the output side. However, in the course of such rolling process, external disturbances due to a roll eccentricity will usually be encountered in the rolling process, which make it impossible or difficult to attain the desired thickness through the ram displacement S determined only by the thickness command *hd.*

Additionally, the rolling mill system including the rolls and housing will undergo deflection, when subjected to a rolling load. Thus, variation in the roll gap is inevitable, even if the ram displacement S is maintained constant.

With a view to overcoming the above difficulties, the thickness $h_2$ at the output side as well as the thickness $h_1$ at the input side are measured to obtain the difference $(h_1 - h_2)$ between them, which difference is applied to the coefficient multiplier 12 having the coefficient $\xi$ to determine the error or variation of thickness due to the deflection of the mill system. This error is compensated by the load feed back coefficient $\alpha$ through the coefficient multiplier 13 and fed back to the input side of the hydraulic servo system 11. Additionally, the displacement S of the screw-down ram is fed back to the input side of the hydraulic servo system 11, thereby to constitute a thickness control system. The above described arrangement of the thickness control system is substantially similar to the BISRA AGC type control system described above in conjunction with FIG. 1, except for a difference in that the difference in thickness between the input and the output sides is measured and fed back in the former system, while in the latter the rolling pressure is directly measured and fed back for the comparison with the thickness command.

In the aforementioned control systems, the external disturbance due to the roll eccentricity *e* will exert an influence to the thickness $h_2$ at the output side. However, the system has no measure to controllably eliminate such influence. According to the present invention, an additional feed back path containing a novel eccentricity control unit 14 is branched from the aforementioned feed back path of the rolling pressure signal and connected, as a positive feed back, to the input side of the hydraulic servo system 11.

The eccentricity control unit 14 is practically composed of a filter of narrow band width allowing only the passage of the eccentricity frequency and an amplifier having a gain Kc.

In this case, the relation between the roll eccentricity *e* and the thickness variation $\Delta h_2$ at the output side can be given by the following expression:

$$\frac{\Delta h_2}{e} = \frac{1}{1 + (1 - \alpha) + K_c \xi}$$

It can be seen from the above expression that, in the state where the rolling pressure is fed back, in polarity as shown, under the feed back coefficient $\alpha$ selected equal to 1, the transmissibility of the eccentricity *e* to the thickness $h_2$ at the output side can be decreased in proportional dependence upon the value of $K_c$, since the above expression in such case can be simplified in the following form;

$$\frac{\Delta h_2}{e} = \frac{1}{1 + K_c \xi}$$

The value of $\xi$ is usually in the range of 2 to 3, and it has been experimentally found that the value of $K_c$ can be varied in the range of 0.5 to 20 in term of the ratio to $\alpha$. A larger value of the gain $K_c$ gives effects that the mill stiffness is decreased by control means for compensation for the roll eccentricity with a result that a roll eccentricity is scarcely transmitted to the thickness variation $\Delta h_2$ at the output side.

Figure 3:
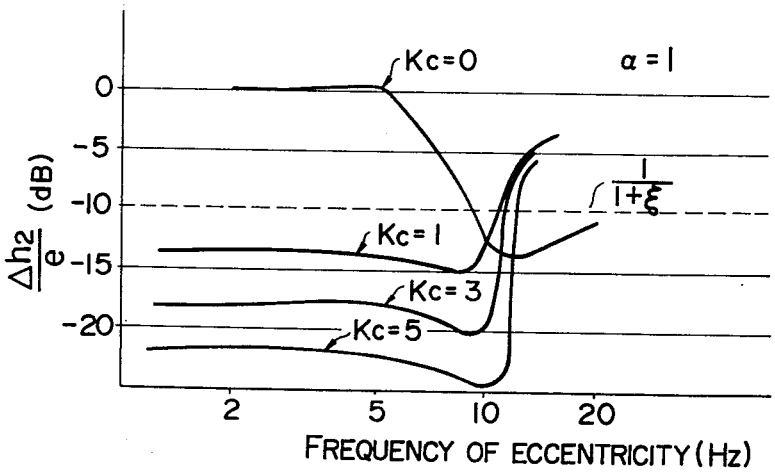
FIG. 3 graphically illustrates performance characteristics of a control system according to the invention.

Next, description will be made as to how the preferred value of the gain $K_c$ can be determined. FIG. 3 graphically illustrates the value of $\Delta h_2/e$ as a function of the eccentricity frequency as measured in an actual hydraulic screw-down apparatus for a rolling mill. In the figure, the deviation of $\Delta h_2/e$ is shown as changing the value of $K_c$ under the load or pressure feed back coefficient $\alpha$ selected equal to 1. When $K_c = 0$, control becomes ineffective and deviation of $\Delta h_2/e$ will become substantially at the level of zero *d*B with $\Delta h_2/e = 1$.

On the other hand, as the gain $K_c$ is progressively increased from 1 to 3 and 5, the influence of the roll eccentricity to the thickness variation $\Delta h_2$ at the output side is progressively decreased at a practical condition where the eccentricity frequency is within the range of 2 to 10 Hz. It can thus be found that the influence of the roll eccentricity can be effectively reduced, as compared with the state where no BISRA control is applied, i.e. $K_c = 1/(1 + \xi)$ without any unfavourable result by selecting the gain $K_c$ greater than 1.

Next, explanation will be made of how to realize the filter of a narrow band width which is required to follow the rotation of the rolls. According to the invention, this has been solved by employing a correlation filter which functions to determine the correlation between the roll rotation signals and the rolling force or pressure. The correlation filter can be constructed on the basis of either digital or analogue technique, depending upon the actual arrangement of the employed control system.

Figure 4:
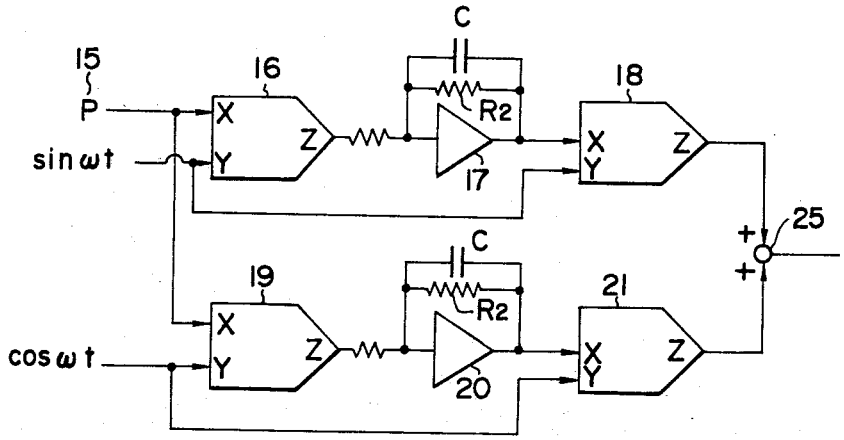
FIG. 4 is a block diagram showing an analogue correlation filter for use in the control system according to the invention.

FIG. 4 shows exemplarily a correlation filter of an analogue type which comprises multipliers 16 and 19, analogue integrators 17 and 20, and multipliers 18 and 21 connected in series in parallel paths. The rolling pressure P is multiplied by roll rotation signals of sin $\omega t$ and cost $\omega t$ ($\omega$ represents angular rotational speed of the roll) at the respective multipliers 16 and 19, the outputs of which are integrated by the associated analogue integrators 17 and 20 each comprising a resistor and a capacitor. The output signals from these integrators are again multiplied by the rotation signals of sin $\omega t$ and cos $\omega t$ at the multipliers 18 and 21 and finally added together at a summing junction 25. The output thus finally available will represent the correlation between the roll pressure P and the rotation signal components of the roll. In other words, only the roll rotation component can be extracted from the rolling pressure signal P, which includes both components of the strip thickness at the input side and the roll eccentricity. Thus the circuit functions as the so-called correlation filter. By the way, the characteristic of the correlation filter, i.e. the band width B is determined by the time constants T of the integrators 17 and 20. The band width B becomes narrower, as the time constant T is increased, whereby only the roll eccentricity component can be obtained. When the integrator is composed of the resistor and the capacitor as in the case of circuit shown in FIG. 3, the time constant T is determined by the product of capacitance C and resistance $R_2$ of the respective elements. The band width B can be set at a predetermined value by selecting the values of C and $R_2$. In general, the upper and the lower rolls have often some differences in respect of their diameters and the rotational speeds. In such case where one correlator is used, for the compensation of these differences, the band width B of the correlation filter should be widened by $\Delta\omega = |\omega_1 - \omega_2|$, wherein $\omega_1$ and $\omega_2$ represent the rotation speeds of the upper and the lower backup rolls, respectively.

The above description has been made on the assumption that the roll gap variation during rotation of rolls due to roll eccentricity includes substantially only a component of the fundamental frequency of roll rotation. However, it has been found from our study that it includes components of various harmonics, such as the second, third and so on, of the fundamental frequency, but the components of the second and third harmonics are especially greater than the components of harmonics of the higher orders and hence it will be enough for the purpose of practical use to preclude only effects of the components of roll eccentricity having the fundamental frequency and the second and third harmonics. In other words, it has been found that the compensation for roll eccentricity is effectively applicable to the automatic gage control by precluding the effects of components of the roll eccentricity, respectively, having the fundamental frequency $\omega$, corresponding to the angular velocity in rotation of the upper roll, and its second and third harmonics $\omega_2$ and $\omega_3$, and the fundamental frequency $\Omega_1$ corresponding to the angular velocity in rotation of the lower roll and its second and third harmonics $\Omega_2$ and $\Omega_3$ by using suitable correlation circuitry.

Figure 5:
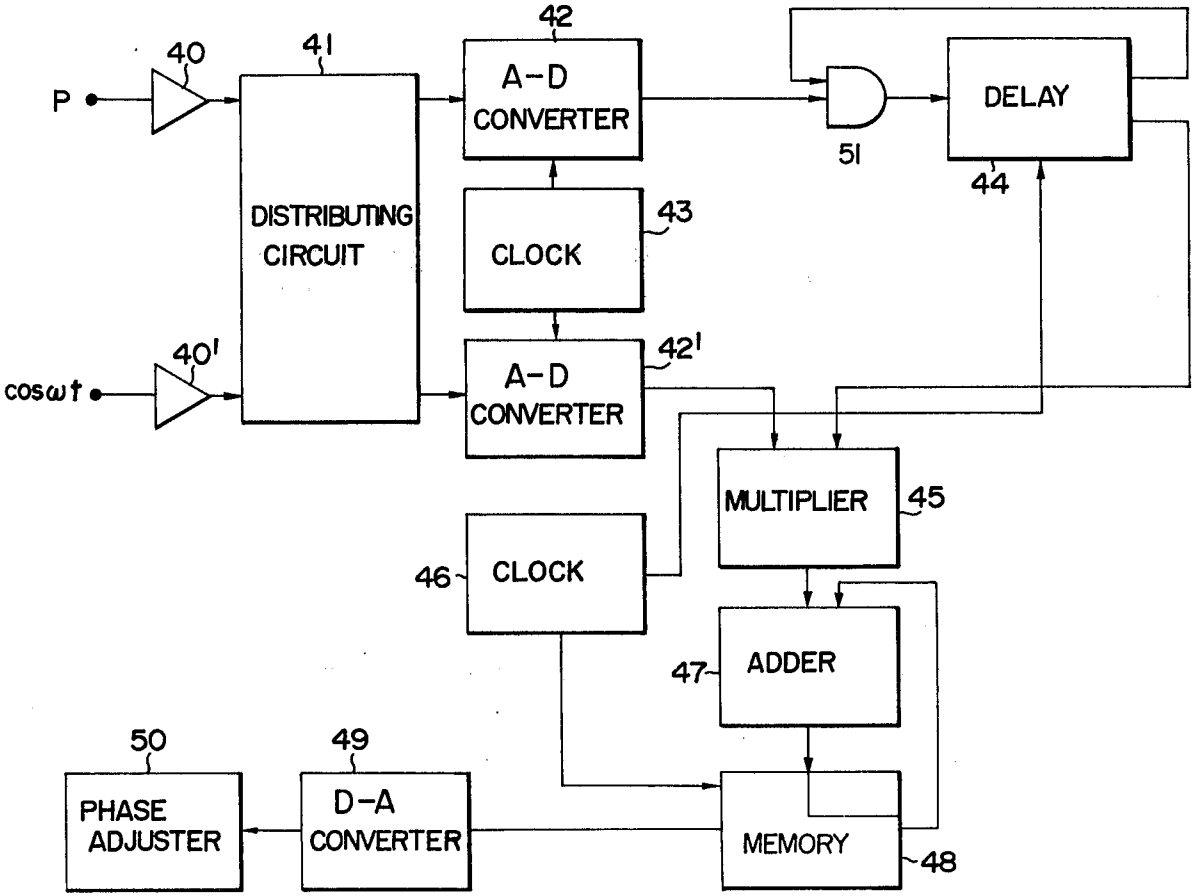
FIG. 5 shows in a block diagram an arrangement of a digital type correlation filter according to the invention.

FIG. 5 shows an embodiment of a correlation filter of a digital type according to the invention. In the case of this correlation filter, the rolling present P and the reference signal cos $\omega t$ are applied to a disturbing circuit 41 through respective gain regulators 40 and 40'. The output signals from the distributing circuit 41 are fed to analogue-to-digital or A-D converters 42 and 42' for the A-D conversion under the timing control of clock pulses produced by a pulse generator 43. Thereafter, the rolling pressure signal P is delayed through a delay circuit 44 controlled by gate 51. The delayed rolling pressure signal P is then multiplied by the reference signal cos $\omega t$ at a multiplier 45. The output from the multiplier 45 is subjected to an averaging integrating operation to obtain an average of integration of the output through an adder 47 and a memory 48 under the control of the timing signal produced by a timing generator 46. The output signal of the memory 48 then undergoes a D-A conversion at a D-A converter 49. A circuit 50 serves to adjust the phase of the signal from the converter 49 on the real time basis, thereby to provide a final output.

According to the invention, it has been found that the strip thickness $h_2$ at the output side is substantially completely free from the influence of the roll eccentricity by reducing or softening the effective mill stiffness according to the frequency of roll eccentricity.

However, when the roll eccentricity frequency is increased, the influence thereof to the thickness $h_2$ becomes greater as can be seen from FIG. 3. It is therefore preferred to dispose a phase compensation circuit having a phase advancing characteristic 14' connected to the correlation filter, with a view to further compensating the influence of an increased eccentricity frequency.

As will be appreciated from the foregoing description, the control system according to the invention can assure an adequate correction of the roll eccentricity by allowing the softening of the rolling mill stiffness by control means only for the roll eccentricity frequency.

We claim:

1. A gage control system for use with a rolling mill comprising roll means for defining a roll gap through which a material is passed to be rolled and hydraulic pressure means adapted to set the roll gap at a given value and to control a rolling pressure applied through said roll means to the material passing through said roll gap, said system comprising:

gap setting means for applying a gage command to said pressure means to set the roll gap at a predetermined value, position setting means for detecting the actual value of the roll gap and feeding back a gap signal corresponding to the actual value of the roll gap to said pressure means, pressure detecting means for detecting the rolling pressure applied to the material passing through the roll gap and determining the amount of deformation of said rolling mill from the detected rolling pressure, multiplier means for multiplying the output of said pressure detecting means relating to the amount of said deformation by a predetermined coefficient and applying, as a negative back, the result of said multiplication to said pressure means, and feed back means for applying, as positive feed back, the output of said pressure detecting means through a narrow-band filter to said pressure means, said filter allowing the passage of substantially only components relating to eccentricity of said roll means.

2. A gage control system according to claim 1, wherein the gain of said feed back means is set at a value of 0.5 to 20 times of the value of said predetermined coefficient.

3. A gage control system according to claim 1, wherein said narrow band filter comprises a correlation circuitry for producing a signal relating to the correlation between the rolling pressure and the rotation of said roll means.

4. A gage control system according to claim 2, wherein the gain of said feed back is set at a value greater than 1 times the value of said predetermined coefficient.

5. A gage control system according to claim 3, wherein said correlation circuitry produces a signal relating to the correlation between the rolling pressure and a frequency signal relating to the rotation of said roll means.

6. A gage control system for use with a rolling mill comprising roll means for defining a roll gap through which a material is passed to be rolled and hydraulic pressure means responsive to a control signal applied thereto for applying a controlled rolling pressure to said roll means to control said roll gap, said system comprising:

means for producing a roll gap signal indicative of the distance of said roll gap, means for producing a rolling pressure signal indicative of the rolling pressure applied to the material passing through said roll gap, means for producing said control signal applied to said hydraulic pressure means as a function of a gage command indicative of the predetermined desired gage of the material as rolled, said roll gap signal and said rolling pressure signal, means for obtaining a correlation between said rolling pressure signal and a frequency signal relating to the rotation of said roll means and producing a roll eccentricity signal as a function of said correlation, and means for correcting said control signal according to said roll eccentricity signal.

7. A gage control system according to claim 6, wherein said rolling pressure signal is produced by a pressure gage provided for measuring the pressure imparted on said roll means by said hydraulic pressure means.

8. A gage control system according to claim 6, wherein said rolling pressure signal is produced as a function of the thicknesses of the material at the input and output sides of said roll means.

9. A gage control system according to claim 6, wherein said control signal producing means comprises means for producing a difference signal indicative of the difference between said gage command and said roll gap signal, means for determining the amount of deformation of said rolling mill from said rolling pressure signal, multiplier means for multiplying the output of said determining means by a predetermined coefficient, and negative feed back means for applying the output of said multiplier means, as negative feed back, to said difference signal producing means, and said correcting means comprises positive feed back means for applying said roll eccentricity signal, as positive feed back to said difference signal producing means.

10. A gage control system according to claim 9, wherein the gain of said positive feed back means is set at a value of 0.05 to 20 times the value of said predetermined coefficient.

11. A gage control system according to claim 10, wherein the gain of said positive feed back means is set at a value greater than 1 times the value of said predetermined coefficient.

12. A gage control system according to claim 6, wherein the frequency signal relating to the rotation of said roll means includes at least one of the fundamental frequency of roll rotation and harmonics thereof.

13. A gage control system according to claim 12, wherein the frequency signal includes the fundamental frequency and second and third harmonics thereof.

14. A gage control system according to claim 6, wherein said correcting means serves for reducing the effective rigidity of the mill when the roll eccentricity serves to increase the rolling pressure.

15. A gage control system according to claim 14, wherein said correcting means is provided with a gain greater than 1.

* * * * *